US006505582B2

(12) United States Patent
Moteki et al.

(10) Patent No.: US 6,505,582 B2
(45) Date of Patent: Jan. 14, 2003

(54) VARIABLE COMPRESSION RATIO MECHANISM OF RECIPROCATING INTERNAL COMBUSTION ENGINE

(75) Inventors: Katsuya Moteki, Tokyo (JP); Hiroya Fujimoto, Kanagawa (JP); Shunichi Aoyama, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/899,038

(22) Filed: Jul. 6, 2001

(65) Prior Publication Data

US 2002/0002957 A1 Jan. 10, 2002

(30) Foreign Application Priority Data

Jul. 7, 2000 (JP) ..... 2000-206257

(51) Int. Cl.[7] ..... F02B 75/04
(52) U.S. Cl. ..... 123/48 B; 123/78 F; 123/78 E
(58) Field of Search ..... 123/48 B, 78 E, 123/78 F

(56) References Cited

U.S. PATENT DOCUMENTS 4,517,931 A * 5/1985 Nelson ..... 123/48 B
5,595,146 A * 1/1997 Bollig et al. ..... 123/48 B

* cited by examiner

*Primary Examiner*—Erick Solis
(74) *Attorney, Agent, or Firm*—Foley & Lardner

(57) ABSTRACT

A variable compression ratio mechanism of a reciprocating engine includes at least an upper link connected at one end to a piston pin and a lower link connecting the other end of the upper link to a crankpin. At top dead center, when hypothetical connecting points between the upper and lower links are able to be supposed on both sides of the line segment connecting the piston-pin center and the crankpin center, and the first one of the connecting points has a smaller inclination angle, measured in the same direction as a direction of rotation of the crankshaft, from the axial line of reciprocating motion of the piston-pin center and to a line segment connecting the piston-pin center and the first connecting point; as compared to the second connecting point, the first connecting point is selected as the actual connecting point.

9 Claims, 13 Drawing Sheets

I V · Wexp I
T

+
ϕ
0
-

W
0

PISTON STROKE
θ1
TDC
0
90
180
270
360
CRANK ANGLE deg

I V · Wexp I
T

+
ϕ
0
-

W
0

PISTON STROKE
TDC
0
90
180
270
360
CRANK ANGLE deg

I V · Wexp I
0

+
ϕ
0
-

W
0

PISTON STROKE

0
Wexp

+
θ2
V
0
-
0
90
180
270
360
CRANK ANGLE deg

VARIABLE COMPRESSION RATIO MECHANISM OF RECIPROCATING INTERNAL COMBUSTION ENGINE

TECHNICAL FIELD

The present invention relates to a variable compression ratio mechanism of a reciprocating internal combustion engine, and particularly to a variable compression ratio mechanism of a reciprocating piston engine capable of varying the top dead center (TDC) position of a piston by means of a multiple-link type piston crank mechanism.

BACKGROUND ART

In order to vary a compression ratio between the volume in the engine cylinder with the piston at bottom dead center (BDC) and the volume with the piston at top dead center (TDC) depending upon engine operating conditions such as engine speed and load, in recent years, there have been proposed multiple-link type reciprocating piston engines each employing a multiple-link type piston crank mechanism (multiple-link type variable compression ratio mechanism) composed of three links, namely an upper link, a lower link, and a control link.

SUMMARY OF THE INVENTION

In a multiple-link type variable compression ratio mechanism, assuming that an angle (an inclination angle $\phi$ of an upper link) between an axial line of the upper link and an axial line of the direction of reciprocating motion of a piston pin center, becomes approximately 0° nearby TDC, there are some drawbacks, for the reasons discussed below.

A piston side thrust force is dependent upon the inclination angle $\phi$ and combustion load, and thus an instantaneous energy loss based on a coefficient of friction between the cylinder wall (major thrust face) and the piston, piston speed, and piston side thrust force is also dependent upon the inclination angle $\phi$ of the upper link. Therefore, it is desirable to properly set the inclination angle $\phi$ in particular at a timing point that the product of piston velocity and combustion load becomes maximum after TDC on the compression stroke, from the viewpoint of reduced piston thrust face wear, reduced piston slapping noise, and reduced energy loss.

Accordingly, it is an object of the invention to provide a variable compression ratio mechanism of a reciprocating internal combustion engine, which avoids the aforementioned disadvantages.

It is another object of the invention to provide a variable compression ratio mechanism of a reciprocating internal combustion engine, comprised of upper and lower links and a control link, which mechanism is capable of efficiently reducing energy loss during reciprocating motion of the engine, with a reduced inclination angle $\phi$ of the upper link with respect to an axial line of the direction of reciprocating motion of a piston pin axis, (that is, tan $\phi$), in particular at a timing point (or a crank angle) that an absolute value $|V \cdot Wexp|$ of a product of a piston velocity V during downstroke of the piston and a combustion load Wexp becomes maximum.

In order to accomplish the aforementioned and other objects of the present invention, a variable compression ratio mechanism of a reciprocating internal combustion engine comprises a piston moveable through a stroke in the engine and having a piston pin, a crankshaft changing reciprocating motion of the piston into rotating motion and having a crankpin, a linkage comprising an upper link connected at one end to the piston pin, and a lower link connecting the other end of the upper link to the crankpin. At the top dead center position of the piston, when connecting points between the upper and lower links are able to be supposed on both sides of a line segment connecting the piston-pin center of the piston pin and the crankpin center of the crankpin, and the first one of the connecting points has a smaller inclination angle, measured in the same direction as the direction of rotation of the crankshaft, from the axial line of reciprocating motion of the piston-pin center and formed between a line segment connecting the piston-pin center and the first connecting point; as compared to the second connecting point, the first connecting point is set as the actual connecting point between the upper and lower links.

The other objects and features of this invention will become understood from the following description with reference to the accompanying drawings.

DESCRIPTION OF THE PREFERRED EMBODIMENTS

Figure 1:
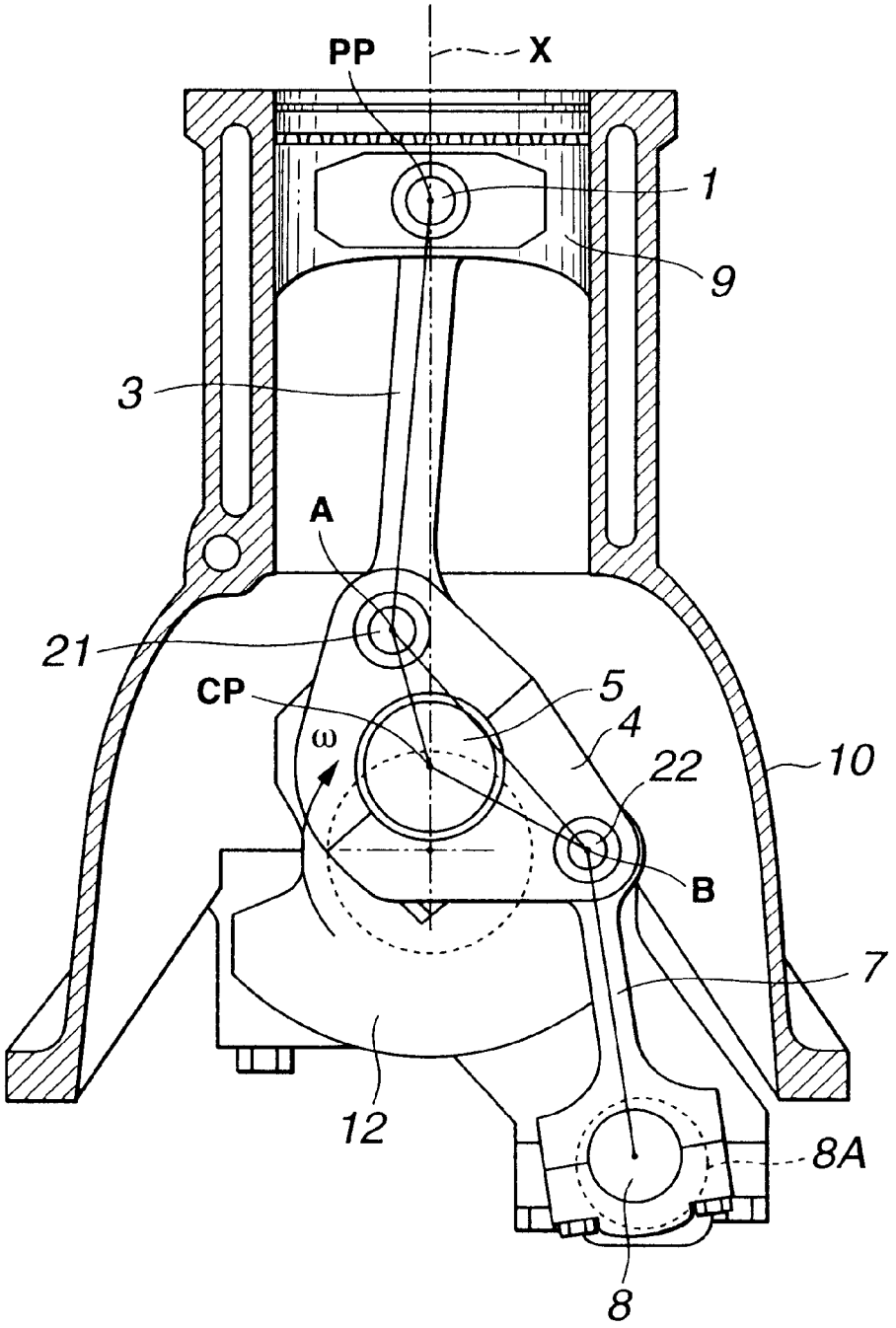
FIG. 1 is a cross-sectional view showing a first embodiment of the variable compression ratio mechanism of the invention.

Referring now to the drawings, particularly to FIG. 1, there is shown a state that piston 9 passes the TDC in the variable compression ratio mechanism of the first embodiment. The variable compression ratio mechanism (the multiple-link type piston crank mechanism) is comprised of upper link 3, lower link 4, and control link 7. The piston is movable through a stroke in the engine and has a piston pin 1. One end of upper link 3 is connected via piston pin 1 to the piston. Lower link 4 is oscillatingly or rockably pin-connected to the other end of upper link 3 by means of a connecting pin 21. Crankshaft 12 changes reciprocating motion of piston 9 into rotating motion and has crankpin 5. Lower link 4 is also rotatably connected to crankpin 5 of crankshaft 12. In more detail, by way of half-round sections of two-split lower link portions bolted to each other, lower link 4 is supported on the associated crankpin 5 so as to permit relative rotation of lower link 4 about the axis of crankpin 5. One end of control link 7 is pin-connected to lower link 4 by means of a connecting pin 22. The other end of control link 7 is connected to the engine body (that is, engine cylinder block 10), so that the center (the pivot axis) of oscillating motion of control link 7 is shifted or displaced relative to the engine body (engine cylinder block 10). By means of the control link, the degree of freedom of lower link 4 is properly restricted. Concretely, the other end of control link 7 is oscillatingly or rockably supported by means of eccentric cam 8 which is fixed to a control shaft 8A and whose rotation axis is eccentric to the axis of control shaft 8A. Control shaft 8A is mounted onto cylinder block 10, and generally actuated by a compression-ratio control actuator (not shown) that is used to hold the control shaft at a desired angular position based on engine operating conditions. Actually, by rotary motion (or angular position) of control shaft 8A, that is, by rotary motion (or angular position) of eccentric cam 8, the center (the pivot axis) of oscillating motion of control link 7 is shifted or displaced relative to the engine body. As a consequence, the TDC position of piston 9, that is, the compression ratio of the engine can be varied, by driving the control shaft at the desired angular position based on engine operating conditions. In the variable-compression ratio mechanism shown in FIG. 1, crank shaft 12 rotates in the direction of rotation indicated by the vector ω (usually, called "angular velocity"), that is, clockwise.

Figures 9A, 9B, 9C, 9D, 9E, 9F:
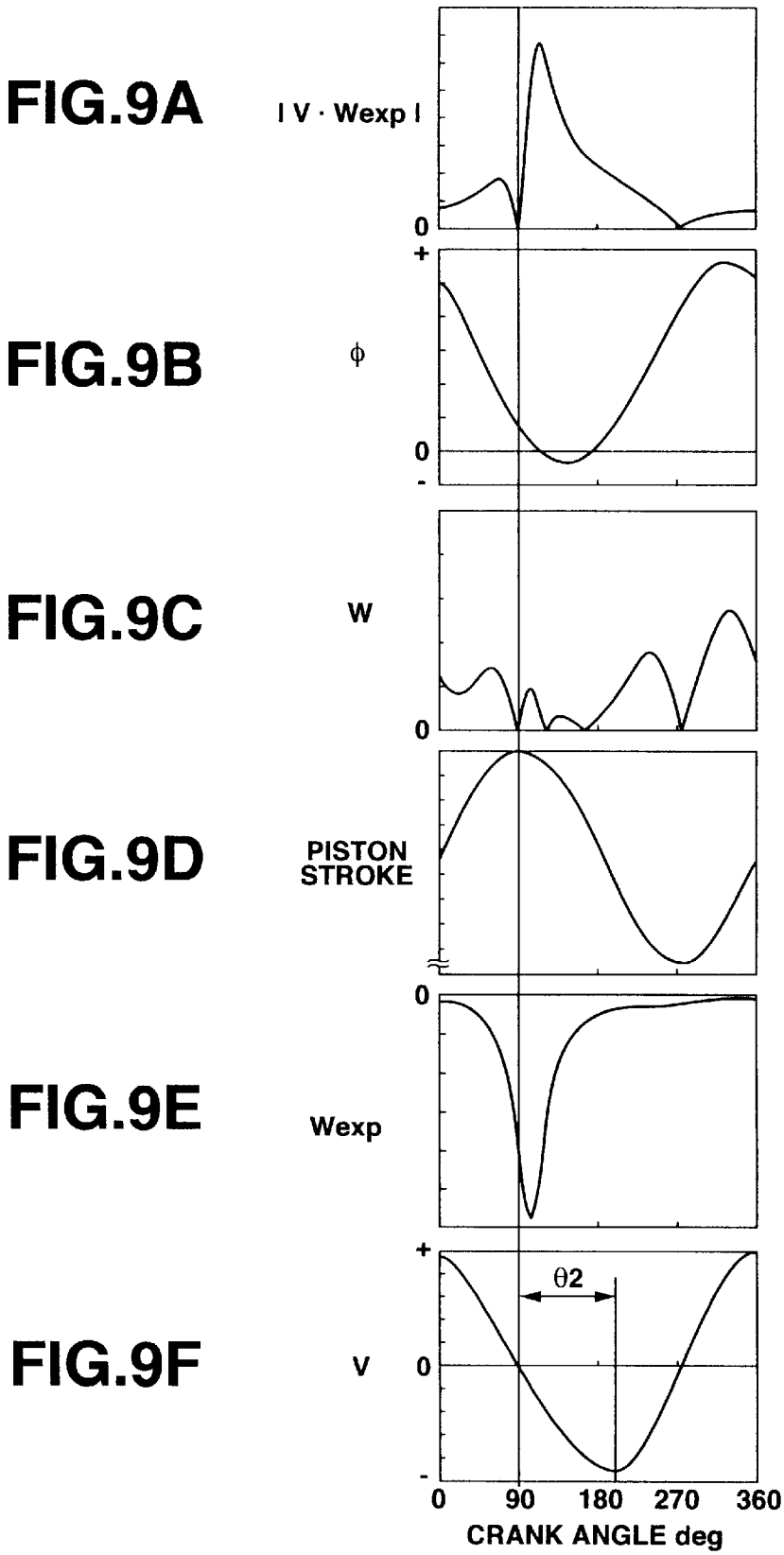
FIGS. 9A–9F show additional characteristic curves of the variable compression ratio mechanism of the first embodiment, namely, variations in the combustion load Wexp and piston velocity V in addition to the characteristics shown in FIGS. 5A–5D (variations in the product |V·Wexp |, inclination angle ϕ, instantaneous energy loss W, and piston stroke).
Figure 14A:
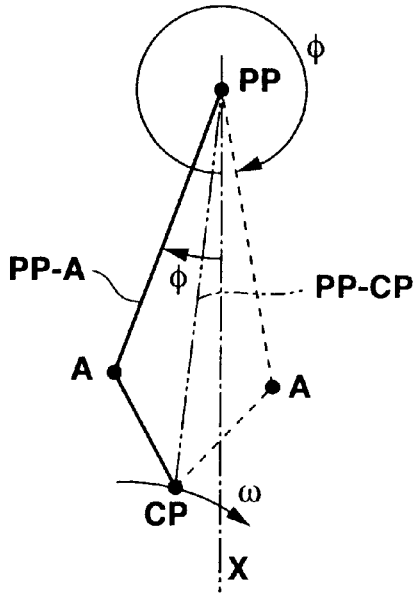
FIGS. 14A and 14B are diagrammatic drawings respectively showing first and second types of the linkage layout (in particular, the relative position relationship among the piston pin center PP, connecting point A between upper and lower links, and crankpin center CP) of the embodiment, at TDC.
Figure 14B:
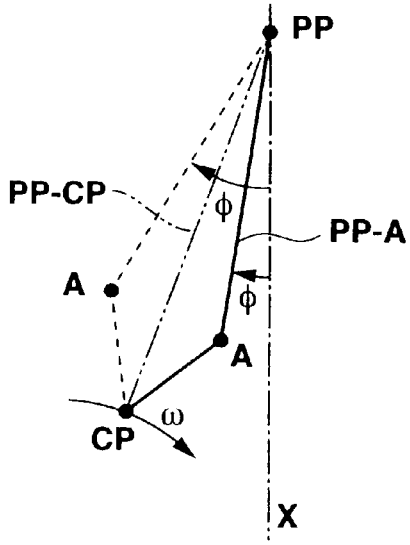
Figure 15A:
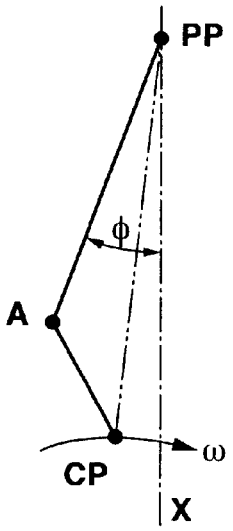
FIG. 15A is a diagrammatic drawing showing one type of the linkage layout of the embodiment at TDC.
Figure 15B:
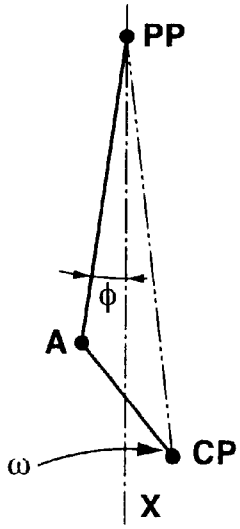
FIG. 15B is a diagrammatic drawing showing another type of the linkage layout of the embodiment after TDC.
Figure 16A:
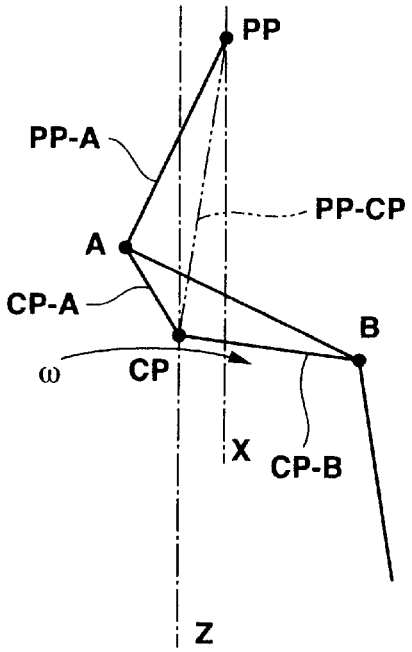
FIG. 16A is a diagrammatic drawing showing the first type (related to FIG. 14A) of the linkage layout (in particular, the relative position relationship among the piston pin center PP, connecting point A, crankpin center CP, and connecting point B) of the embodiment.

Referring now to FIGS. 14A and 14B, there are shown the diagrammatic drawings of the first and second types of the linkage layout of the variable compression ratio mechanism of the first embodiment. FIG. 14A shows the first type of the linkage layout in which two hypothetical connecting points (A, A) between upper and lower links 3 and 4, to be able to be supposed on both sides of a line segment PP–CP between and including piston pin center (piston pin axis) PP and crankpin center CP, are located on both sides of the axial line X of the direction of reciprocating motion of piston pin center PP. On the other hand, FIG. 14B shows the second type of the linkage layout in which two hypothetical connecting points (A, A) between upper and lower links 3 and 4, to be able to be supposed on both sides of line segment PP–CP between and including piston pin center PP and crankpin center CP at TDC, are located on one side of the axial line X of the direction of reciprocating motion of piston pin center PP. In the first type shown in FIG. 14A, on the assumption that inclination angle ϕ of axial line PP–A of upper link 3 relative to axial line X is measured in the same direction as the engine-crankshaft rotational direction indicated by vector ω, the inclination angle ϕ obtained at the left-hand connecting point A of line segment PP–A indicated by the solid line is smaller than the inclination angle ϕ obtained at the right-hand connecting point A of line segment PP–A indicated by the broken line. Therefore, the left-hand side connecting point A of line segment PP–A indicated by the solid line is selected as the actual connecting point A of the multiple-link type variable compression ratio mechanism. In the second type shown in FIG. 14B, on the above-mentioned assumption of inclination angle ϕ, the inclination angle ϕ obtained at the right-hand connecting point A of line segment PP–A indicated by the solid line is smaller than the inclination angle ϕ obtained at the left-hand connecting point A of line segment PP–A indicated by the broken line. Therefore, the right-hand side connecting point A of line segment PP–A indicated by the solid line is selected as the actual connecting point A of the multiple-link type variable compression ratio mechanism. In this manner, according to a fundamental concept of the present invention, of these hypothetical connecting points (A, A) to be able to be supposed on both sides of line segment PP–CP at TDC, only the connecting point A having the smaller inclination angle ϕ is selected and set as the actual connecting point. The linkage layout of the variable compression ratio mechanism of the first embodiment of FIG. 1 corresponds to the first type shown in FIG. 14A, and thus the left-hand side connecting point A as indicated by the solid line of FIG. 14A is selected as the actual connecting point A. As can be seen from the characteristic curves shown in FIGS. 5A–5D, in particular FIGS. 5B and 5D, in the mechanism of the first embodiment of FIGS. 1 and 2, concretely, a particular state that the axial line PP–A of upper link 3 is brought into alignment with the axial line X of the direction of reciprocating motion of piston pin center PP and thus inclination angle $\phi$ becomes 0° during reciprocating motion of the piston, exists only during the piston downstroke (corresponding to the time period denoted by "θ1" in FIG. 5D). In the shown embodiment, within a whole operating range of the engine, the previously-noted particular state that the axial line PP–A of upper link 3 is brought into alignment with the axial line X of the direction of reciprocating motion of piston pin center PP and thus the inclination angle $\phi$ becomes 0°, exists at a timing T that an absolute value $|V \cdot Wexp|$ of the product of piston velocity V and combustion load Wexp becomes a maximum value. The aforementioned timing point T (generally represented in terms of a "crank angle") that the absolute value $|V \cdot Wexp|$ becomes the maximum value varies depending upon a change in engine operating conditions, or upon a change in the compression ratio control based on the change in engine operating conditions. In the mechanism of the embodiment, the linkage is designed and dimensioned so that within the whole engine operating range the inclination angle $\phi$ becomes 0° at at least one timing point (that is, at the timing point T that the absolute value $|V \cdot Wexp|$ becomes the maximum value). Furthermore, as can be seen from the characteristics shown in FIGS. 5A and 5B, the linkage is dimensioned and laid out so that an absolute value $|\phi|$ of inclination angle $\phi$ obtained at the timing point T that the absolute value $|V \cdot Wexp|$ of the product of piston velocity V and combustion load Wexp becomes maximum after TDC on the compression stroke is relatively smaller than the absolute value $|\phi|$ of inclination angle $\phi$ obtained at the TDC position. FIG. 15A shows the state of upper and lower links 3 and 4 of the mechanism of the first embodiment at TDC, while FIG. 15B shows the state of the same at the timing point T after TDC. Due to the relatively smaller inclination angle $\phi$ obtained at timing point T as shown in FIG. 15B, it is possible to effectively decrease tan $\phi$ at timing point T, thereby remarkably reducing the piston side thrust force. Furthermore, as can be seen from FIGS. 9A–9F, in particular FIGS. 9B and 9F, the particular state that the axial line PP–A is brought into alignment with the axial line X and thus the inclination angle $\phi$ becomes 0°, exists for the time period θ2 from the timing point of TDC to the timing point that the absolute value $|V|$ of piston velocity V reaches its peak (see a negative peak value shown in FIG. 9F). FIG. 16A is the diagrammatic drawing of the multiple linkage layout of the mechanism of the first embodiment, and closely related to FIG. 14A. According to the concept of the linkage layout of the invention, as viewed from the diagrammatic drawing of FIG. 16A, at the TDC position, a connecting point B between lower link 4 and control link 7 is located on a first side of a vertical line Z passing through crankpin center CP and arranged parallel to axial line X, while the selected connecting point A is located on the second side of vertical line Z, the first side of vertical line Z corresponding to the opposite side of a direction oriented toward connecting point A from line segment PP–CP (exactly, from a plane including both the piston pin axis PP and the crankpin axis CP). Actually, in FIG. 16A, connecting point A between upper and lower links 3 and 4 is laid out on the left-hand side of line segment PP–CP, and therefore control link 7 and connecting point B are both laid out on the right-hand side (the opposite side) of vertical line Z. As fully described later, such a linkage layout enlarges an angle $\alpha$ formed by the two line segments CP–A and CP–B, thereby resulting in an enhanced displacement multiplication effect of lower link 4. In the shown embodiment, eccentric cam 8 whose center serves as the center of oscillating motion of control link 7 relative to the engine body (cylinder block), is located at the lower right of crankpin 5 (on the right-hand side of axial line X and at the underside of the crankpin). That is, the center of oscillating motion of control link 7 (i.e., the center of eccentric cam 8) is located on the descending side of crankpin 5 (on the right-hand side of vertical line Z (see FIG. 16A) passing through crankpin center CP and arranged parallel to axial line X), while putting axial line X between crankpin 5 and eccentric cam 8. In addition to the above, connecting point B between control link 7 and lower link 4 is located on the same side as eccentric cam 8. At the TDC position of the piston (see FIG. 1), connecting point B is located on the right-hand side of vertical line Z. FIGS. 5A–5D show characteristic curves ($|V \cdot Wexp|$, $\phi$, $W=\mu \cdot V \cdot Wexp \cdot \tan \phi$, and piston stroke) obtained by the variable compression ratio mechanism of the first embodiment with the control link kept at an angular position corresponding to a high compression ratio, while FIGS. 8A–8D show characteristic curves ($|V \cdot Wexp|$, $\phi$, $W=\mu \cdot V \cdot Wexp \cdot \tan \phi$, and piston stroke) obtained by the variable compression ratio mechanism of the first embodiment when the pivot of the control link is kept at an angular position corresponding to a low compression ratio. As can be appreciated from FIG. 8B, during the low compression ratio mode, inclination angle $\phi$ of upper link 3 does not become 0° throughout the reciprocating motion of the piston or within the whole engine operating range. The linkage layout of the variable compression ratio mechanism of the first embodiment is designed and dimensioned so that the absolute value $|\phi|$ of the inclination angle $\phi$ obtained at timing point T during the high compression ratio operating mode (see FIG. 5B) is smaller than that obtained at timing point T during the low compression ratio operating mode (see FIG. 8B).

The variable compression ratio mechanism of the first embodiment operates as follows.

Figure 2:
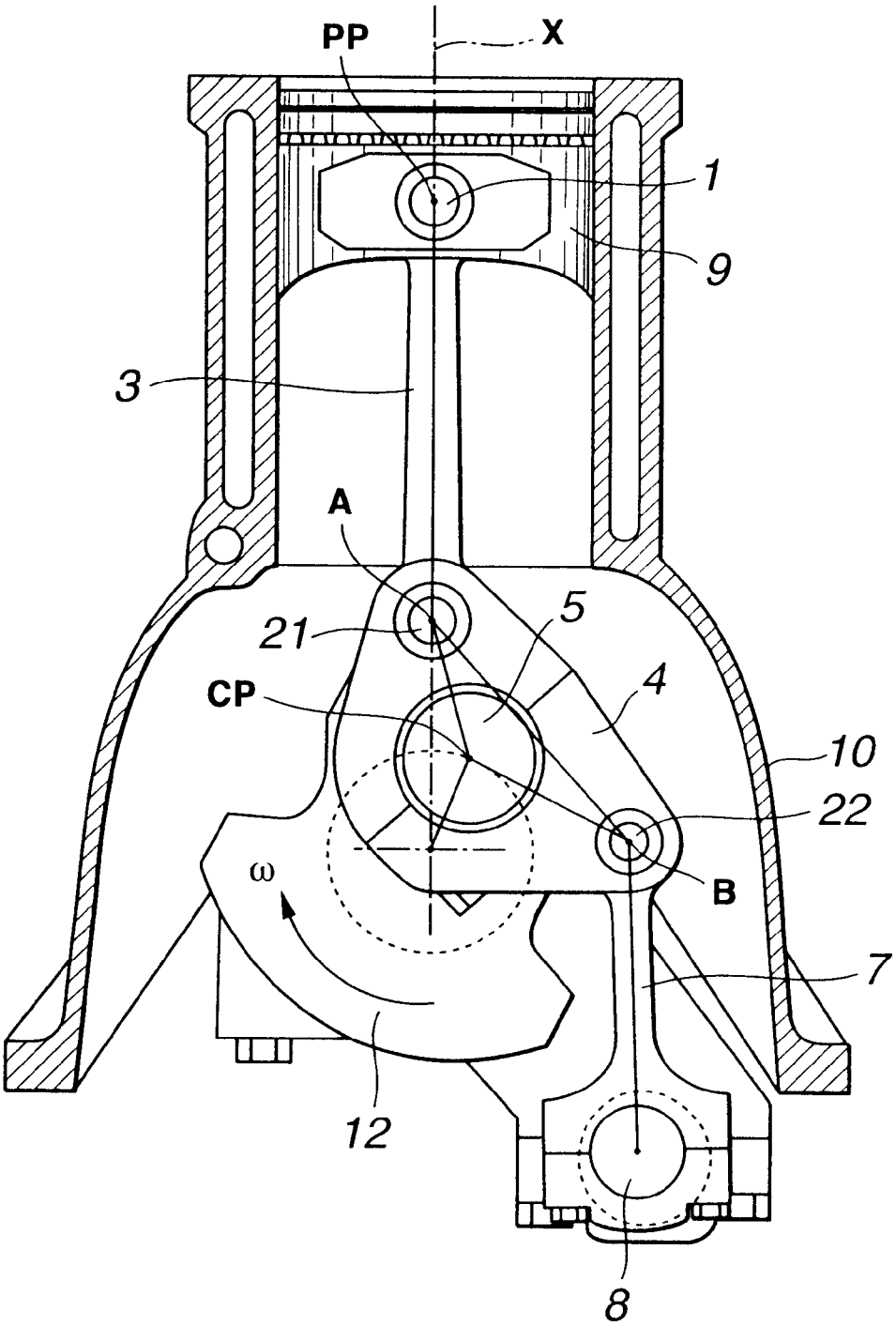
FIG. 2 is a cross-sectional view showing the position relationship between links of the variable compression ratio mechanism of the first embodiment shown in FIG. 1, at a timing point at which an absolute value $|V \cdot Wexp|$ of the product of a piston velocity V and a combustion load Wexp becomes maximum after TDC.
Figure 7:
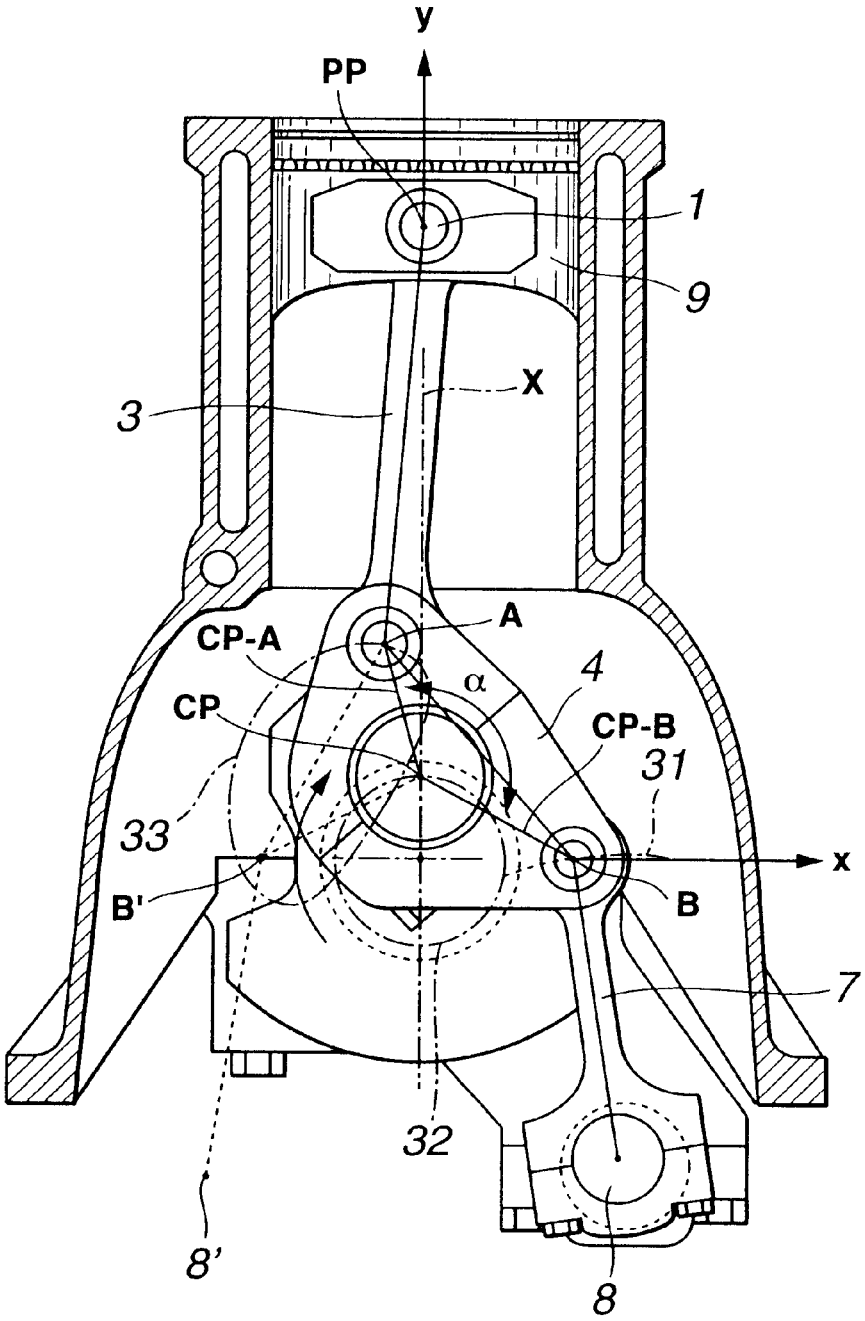
FIG. 7 is an explanatory diagram illustrating the locus of motion (represented by reference sign 31) of a connecting point B between the lower link and the control link, the locus of motion (represented by reference sign 32) of a crankpin center CP, and the locus of motion (represented by reference sign 33) of the connecting point A between the upper and lower links, in the mechanism of the first embodiment.
Figures 8A, 8B, 8C, 8D:
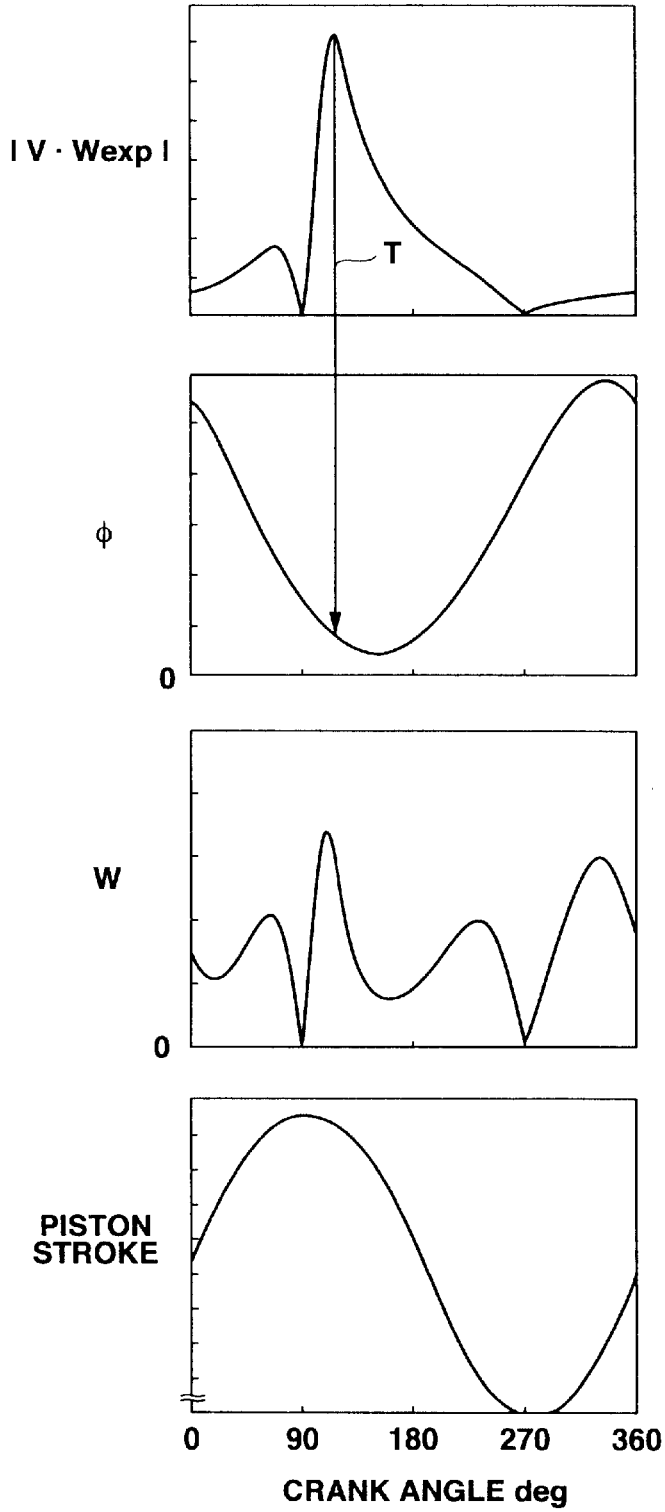
FIGS. 8A–8D show characteristic curves of the variable compression ratio mechanism of the first embodiment of FIG. 1, namely, variations in the product $|V \cdot Wexp|$, inclination angle $\phi$, instantaneous energy loss W, and piston stroke, when the pivot of the control link is kept at an angular position corresponding to a low compression ratio.

As discussed above, in the multiple linkage layout of the embodiment, connecting pin A between upper and lower links 3 and 4 is positioned on the left-hand side of axial line X with respect to the crankpin that swings or rotates clockwise in a circle as the crankshaft rotates, at TDC (see FIGS. 1, 2 and 14A). At the TDC position, as shown in FIG. 1, upper link 3 is inclined by the inclination angle $\phi$ with respect to axial line X, at the TDC position. FIGS. 1 and 2 show the phase relationship between the multiple linkage at TDC (see FIG. 1) and the multiple linkage after TDC or at the timing slightly retarded from TDC or at the initial stage of the piston downstroke (see FIG. 2). When shifting from the state of FIG. 1 to the state of FIG. 2, the upper link approaches closer to its upright state in which axial line PP–A of upper link 3 is brought into alignment with axial line X of the direction of reciprocating motion of piston pin center PP. That is to say, the timing at which inclination angle $\phi$ reduces to a minimum does not occur at the TDC position, but occurs at a timing point retarded slightly from the TDC position, preferably at a timing point T at which the absolute value $|V \cdot Wexp|$ of the product of piston velocity V and combustion load Wexp becomes maximum (see FIGS. 5A and 5B). As set forth above, instantaneous energy loss W occurring owing to piston side thrust force represented by $Wexp \cdot \tan \phi$ is practically determined depending upon the magnitude of the product ($V \cdot Wexp$) of piston speed V and combustion load Wexp, and the magnitude of tan $\phi$ (i.e., the magnitude of angle $\phi$). In other words, the multiple linkage layout of the first embodiment is designed or dimensioned so that inclination angle $\phi$ is brought closer to 0° at the timing point T that the absolute value $|V \cdot wexp|$ of the product of piston velocity V and combustion load Wexp becomes maximum. Therefore, it is possible to effectively reduce instantaneous energy loss W occurring owing to piston side thrust ($Wexp \cdot \tan \phi$). Additionally, the timing point T that inclination angle $\phi$ becomes 0°, axial line PP–A of upper link 3 is brought into alignment with axial line X and thus the upper link is kept in its upright state, exists only during the piston downstroke (corresponding to time period $\theta 1$ in FIG. 5D). As compared to a linkage layout that axial line (PP–A) of upper link 3 is brought into alignment with axial line X of the direction of reciprocating motion of the piston during the piston upstroke, it is possible to more effectively reduce the instantaneous energy loss occurring owing to the piston side thrust force. Even after timing point T, it is possible to keep inclination angle $\phi$ at a comparatively small angle continuously for a designated time period during which the absolute value $|V \cdot Wexp|$ of the product of piston velocity V and combustion load Wexp is still great. Thus, it is possible to remarkably effectively reduce the entire energy loss ($\int W(t)dt$) defined as the value of the integral of instantaneous energy loss W ($=\mu \cdot V \cdot Wexp \cdot \tan \cdot \phi$) during operation of the engine (as appreciated from the characteristic shown in FIG. 5C). Moreover, the linkage is dimensioned and laid out so that the absolute value $|\phi|$ of the inclination angle given at timing point T that the absolute value $|V \cdot Wexp|$ of the product of piston velocity V and combustion load Wexp reaches a maximum value is relatively smaller than the inclination-angle absolute value $|\phi|$ given at the TDC position (see FIG. 5B), thereby effectively reducing the integration value $\int W(t)dt$ of instantaneous energy loss W. Furthermore, in the multiple linkage layout of the first embodiment, the center of oscillating motion of control link 7 relative to the engine body and connecting point B between control link 7 and lower link 4 are located as discussed above. Taking into account the direction (corresponding to the direction indicated by "y" in FIG. 7) of reciprocating motion of the piston, lower link 4 can be regarded as a swing arm whose fulcrum point is the previously-noted connecting point B. On the assumption that the center of eccentric cam 8 is fixed or held constant, connecting point B moves along the circular-arc shaped hypothetical locus-of-motion denoted by reference sign 31. Taking into account the displacement (which will be hereinafter referred to as a "vertical displacement") of connecting point B in the y direction (the direction of piston reciprocating motion), the vertical displacement of the connecting point is negligibly small and thus the motion of connecting point B can be seen as if connecting point B is kept stationary. On the other hand, the previously-noted connecting point A is located on the opposite side of connecting point B, putting or sandwiching crankpin 5 between two connecting pins A and B. Thus, the vertical displacement of connecting point A tends to be enlarged as compared to the vertical displacement of crankpin center CP. In FIG. 7, the circle denoted by reference sign 32 indicates the locus of motion of crankpin center CP, while the substantially elliptical locus of motion denoted by reference sign 33 indicates the movement of connecting point A. As can be seen from comparison between the substantially elliptical locus-of-motion 33 of connecting point A and the circular locus-of-motion 32 of crankpin CP, owing to the properly enlarged vertical displacement of connecting point A, it is possible to provide a longer piston stroke than the diameter of revolution of crankpin 5 around the crankshaft. In other words, it is possible to set the crank radius (exactly, the length of the crank arm located midway between crankshaft 12 and crankpin 5), required to provide a predetermined piston stroke, at a comparatively small value, thus enhancing the rigidity of crankshaft 12. As can be seen from the explanatory view shown in FIG. 7, it will be appreciated that the displacement (which will be hereinafter referred to as a "horizontal displacement") of connecting point B in the x direction perpendicular to the direction of piston reciprocating motion, serves to absorb the horizontal displacement of crankpin center CP.

Figure 10:
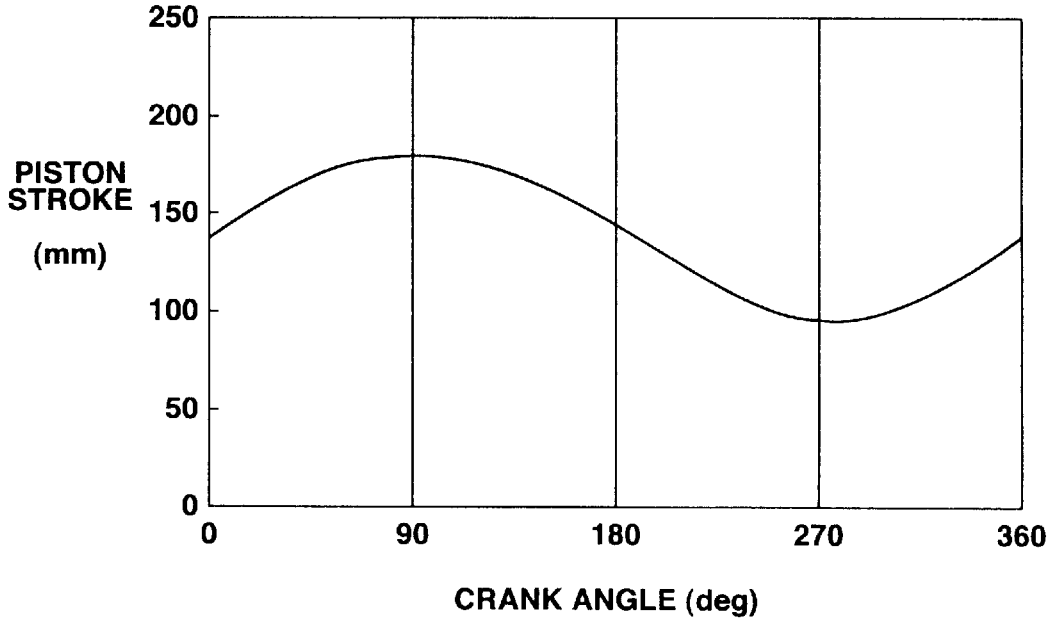
FIG. 10 is a crank angle versus piston stroke characteristic curve obtained by the variable compression ratio mechanism of the first embodiment shown in FIG. 1.
Figure 11:
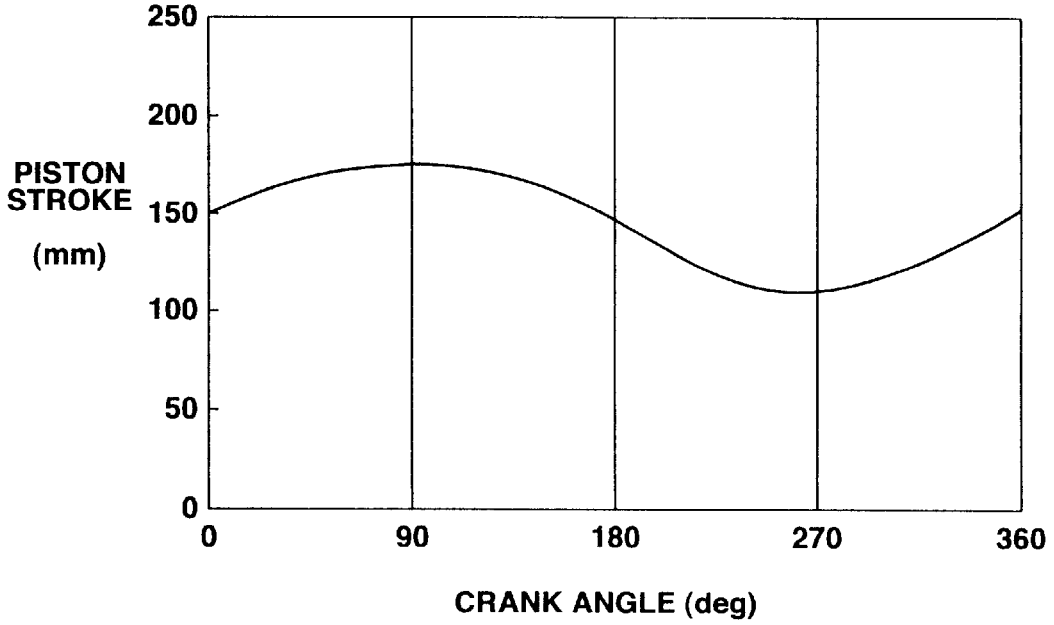
FIG. 11 is a crank angle versus piston stroke characteristic curve obtained by a modification of the mechanism of the first embodiment of FIG. 1.

As indicated by the broken lines in FIG. 7, suppose that the center of oscillating motion of control link 7 and the connecting point between lower link 4 and control link 7 are located on the opposite side, that is, a portion of the multiple linkage layout is changed from the position of eccentric cam 8 and connecting point B indicated by the solid line to the position of eccentric cam 8' and connecting point B' indicated by the broken line. Concretely, the position of eccentric cam 8 and connecting point B indicated by the solid line and the position of eccentric cam 8' and connecting point B' indicated by the broken line are line-symmetrical with respect to axial line X. In other words, at the TDC position, connecting point B' between the hypothetical lower link and control link is located on a second side of vertical line Z passing through crank pin center CP and arranged parallel to axial line X, the second side of vertical line Z corresponding to the same side as the direction oriented toward connecting point A from line segment PP–CP (exactly, from the plane including both the piston pin axis PP and the crankpin axis CP). At this time, as appreciated from comparison between the triangle Δ CPAB formed by three points CP, A and B, and the triangle Δ CPAB' (hereinafter is referred to as a "hypothetical triangle") formed by three points CP, A and B', the angle $\alpha$ (i.e., ∠ACPB') between line segments CP–A and CP–B' of the hypothetical triangle Δ CPAB' tends to be smaller than the angle $\alpha$ (i.e., ∠ACPB) between line segments CP–A and CP–B of the triangle Δ CPAB. In case of the linkage layout corresponding to the hypothetical triangle $\alpha$ CPAB' indicated by the broken line, the vertical displacement multiplication effect of lower link 4 serving as the swing arm, will be reduced undesirably. FIG. 10 shows the crank angle versus piston stroke characteristic with the linkage layout (see reference signs 8 and B) indicated by the solid line in FIG. 7 in which both ends of control link 7 are positioned on the right-hand side of axial line X. On the contrary, FIG. 11 shows the crank angle versus piston stroke characteristic with the hypothetical linkage layout (see reference signs 8' and B') indicated by the broken line in FIG. 7 in which both ends of control link 7 are positioned on the left-hand side of axial line X. As appreciated from comparison between the characteristics of FIGS. 10 and 11, there results a remarkable difference between piston stroke characteristics by changing the layout of the control link with respect to axial line X serving as a reference line. Actually, the amplitude (piston stroke) of the characteristic curve of FIG. 10 is longer than that of FIG. 11. As compared to connecting point B' between the lower link and control link located, at TDC, on the second side of vertical line Z whose second side corresponds to the same side as the direction oriented toward connecting point A from line segment PP–CP, in the linkage layout of the invention that connecting point B between the lower link and control link located, at TDC, on the first side of vertical line Z whose first side corresponds to the opposite side as the direction oriented toward connecting point A from line segment PP–CP, it is possible to more effectively increase the vertical displacement multiplication effect of lower link 4 that multiplies the ratio of piston stroke to the diameter of revolution of crankpin 5 (or the ratio of piston stroke to crank radius). Therefore, it is possible to set the crank radius (i.e., the length of the crank arm) required to provide a predetermined piston stroke at a comparatively small value, thus enhancing the rigidity of crankshaft 12. Furthermore, as described previously, the linkage layout of the variable compression ratio mechanism of the first embodiment is designed and dimensioned so that the inclination angle $\phi$ obtained at timing point T during the high compression ratio (see FIG. 5B) is smaller than that obtained at timing point T during the low compression ratio (see FIG. 8B). During the high compression ratio operating mode in which a thermodynamic efficiency of the engine is high, it is possible to more effectively reduce the energy loss arising from piston side thrust, thus enhancing the maximum efficiency of the engine.

Figure 3:
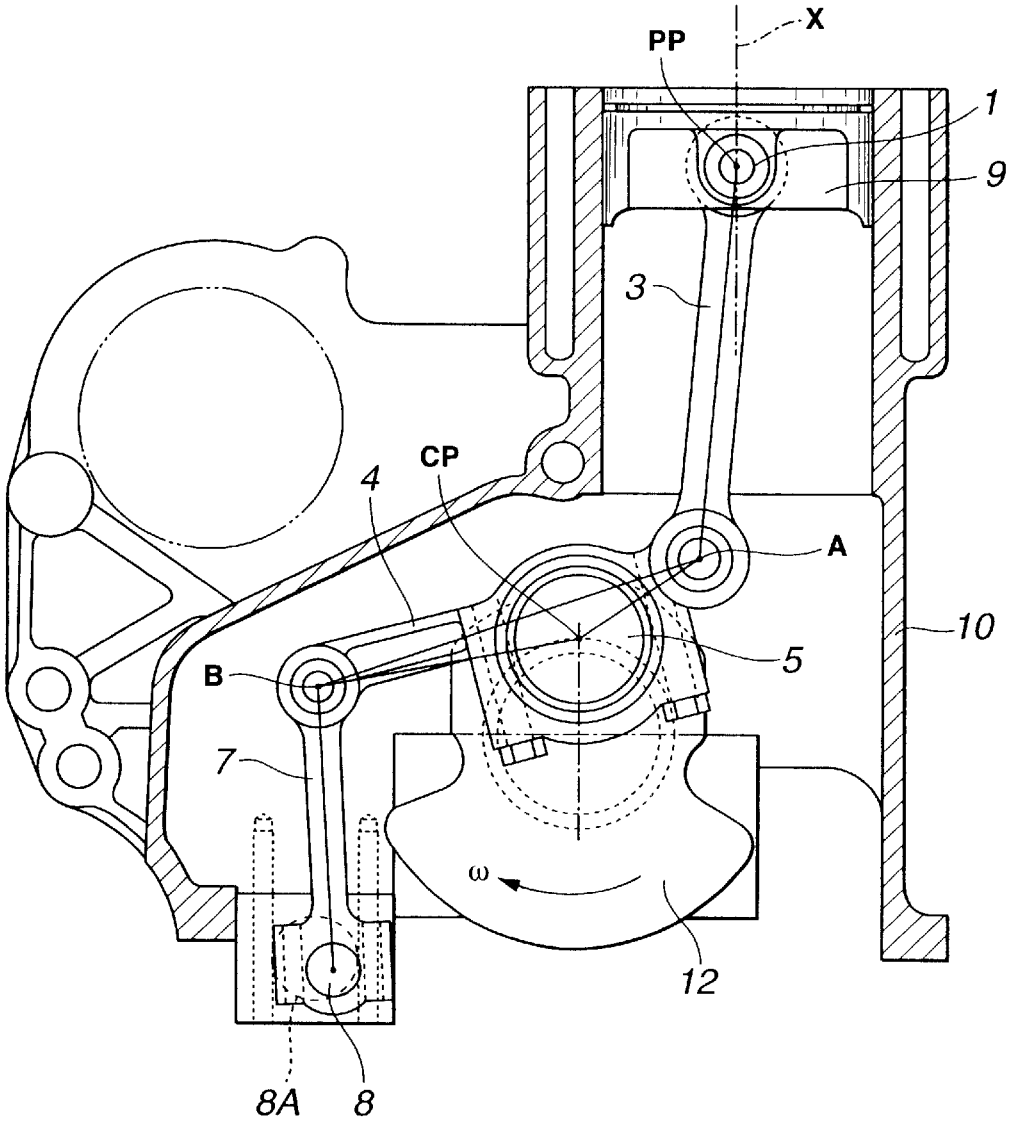
FIG. 3 is a cross-sectional view showing a second embodiment of the variable compression ratio mechanism of the invention.
Figure 4:
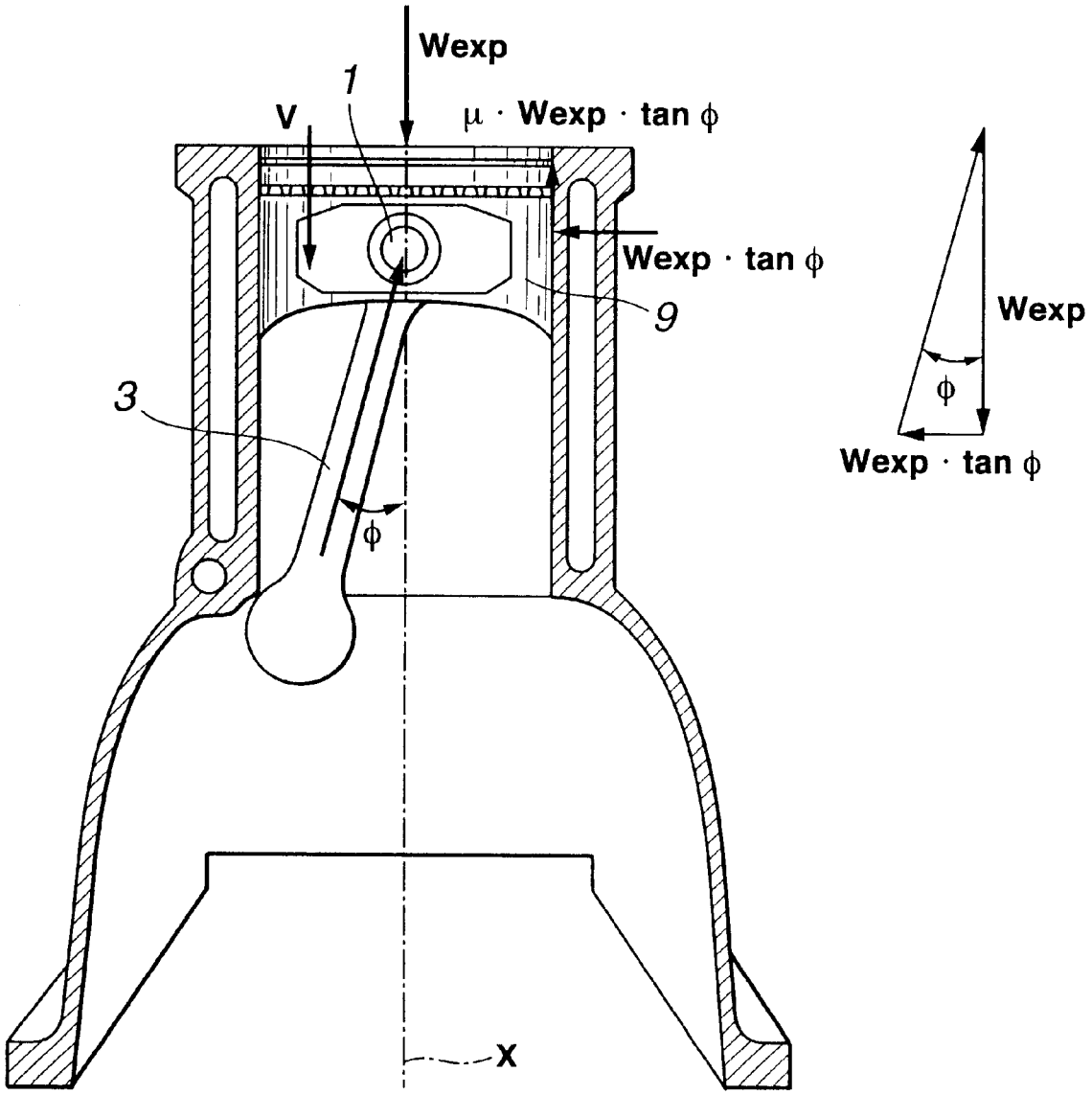
FIG. 4 is an explanatory drawing illustrating analytical mechanics (vector mechanics) for applied forces or loads (Wexp, Wexp·tan$\phi$, $\mu$·Wexp·tan $\phi$) and piston velocity V, at the inclination angle $\phi$ of the upper link.
Figures 5A, 5B, 5C, 5D:
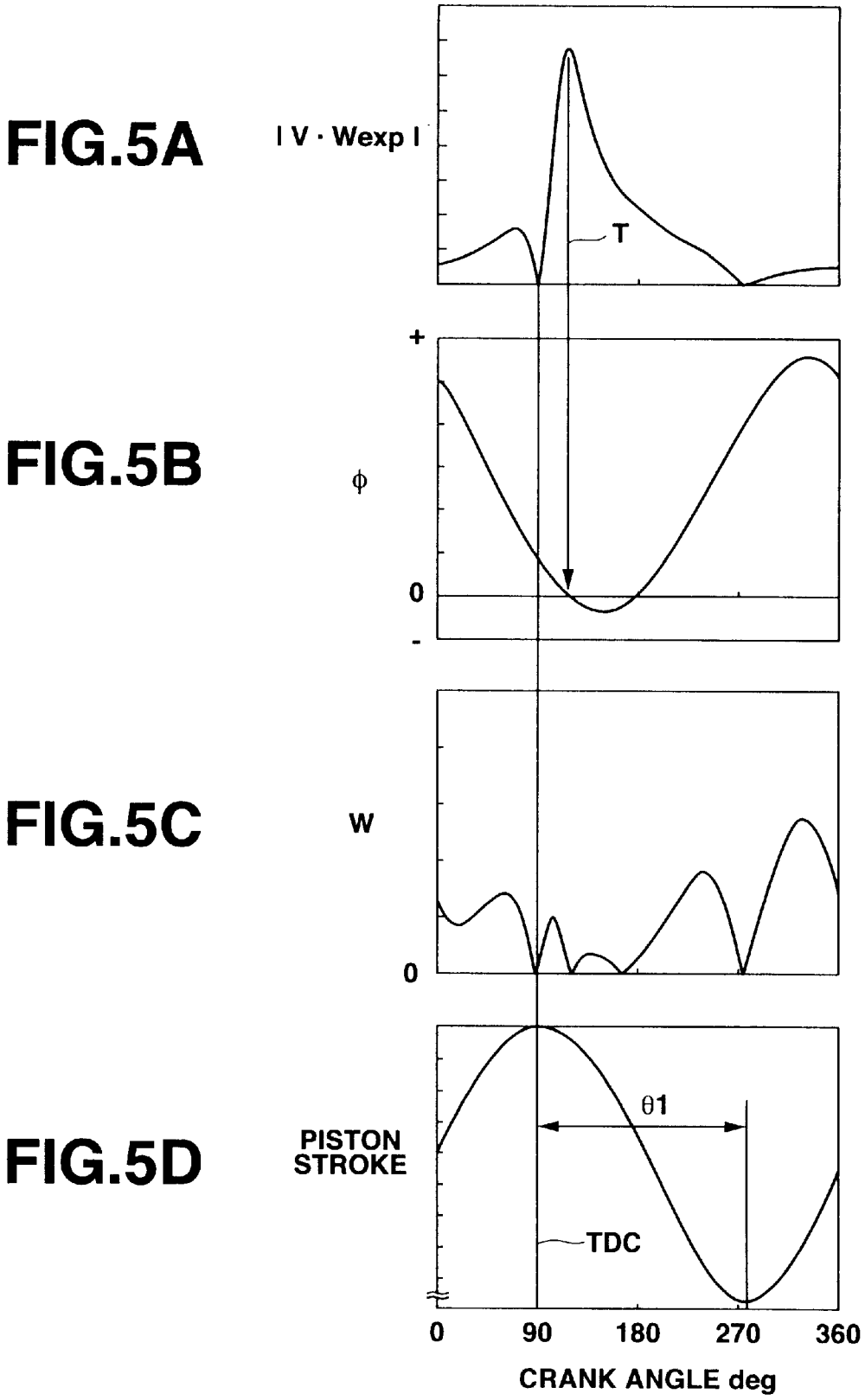
FIGS. 5A–5D show characteristic curves of the variable compression ratio mechanism of the first embodiment of FIGS. 1 and 2, namely, variations in the product $|V \cdot Wexp|$, inclination angle $\phi$, instantaneous energy loss W ($=\mu \cdot V \cdot Wexp \cdot \tan \phi$), and piston stroke, near the expansion stroke and when the pivot of the control link is kept at an angular position corresponding to a high compression ratio.
Figures 6A, 6B, 6C, 6D:
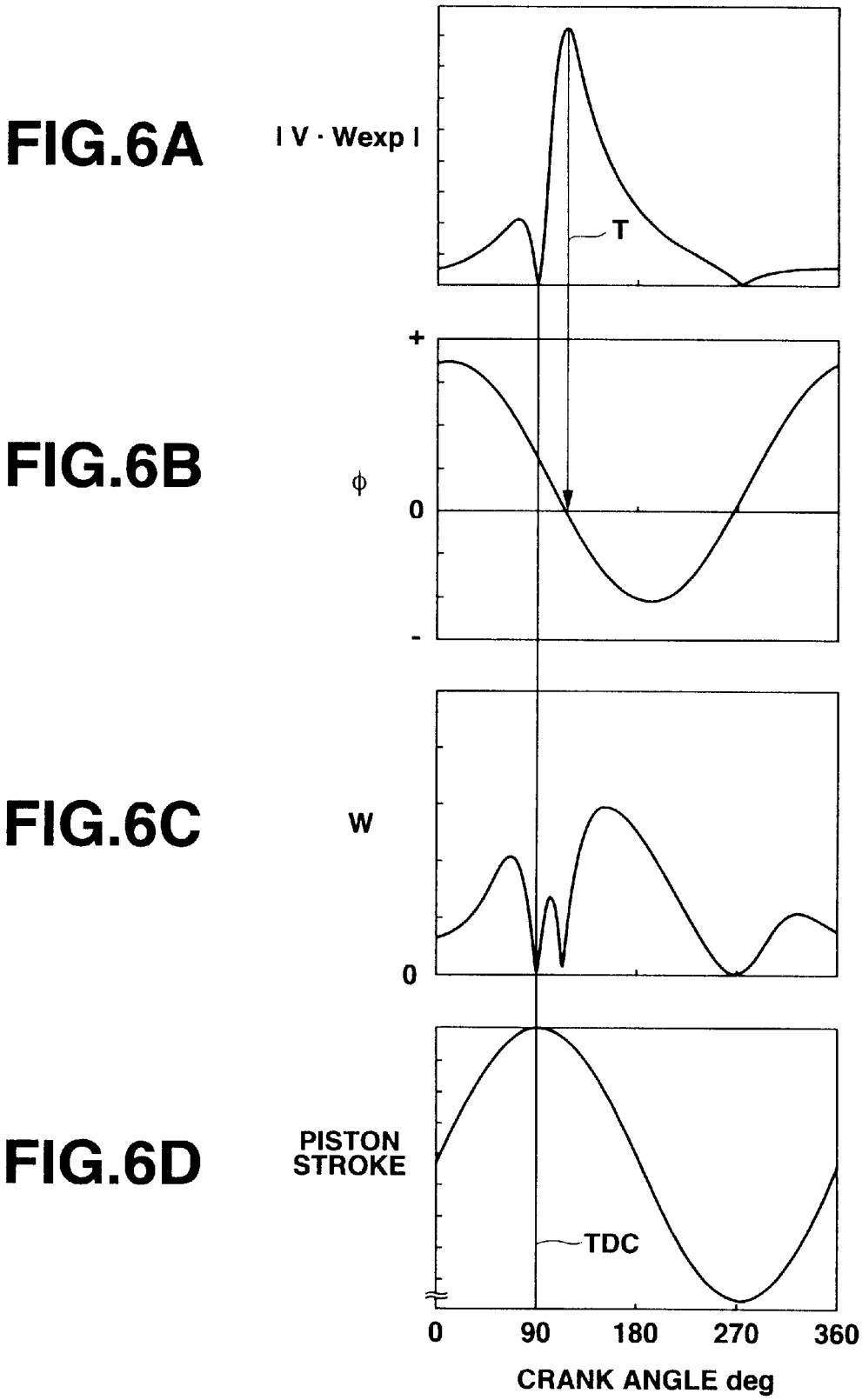
FIGS. 6A–6D show characteristic curves of the variable compression ratio mechanism of the second embodiment of FIG. 3, namely, variations in the product $|V \cdot wexp|$, inclination angle $\phi$, instantaneous energy loss W, and piston stroke, near the expansion stroke.
Figure 12:
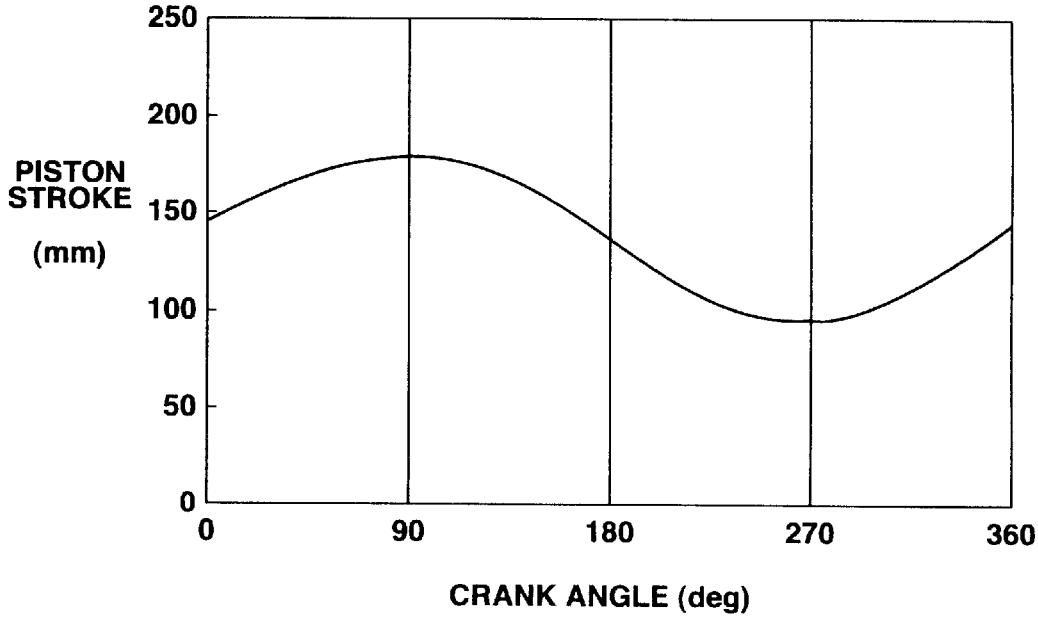
FIG. 12 is a crank angle versus piston stroke characteristic curve obtained by the variable compression ratio mechanism of the second embodiment shown in FIG. 3.
Figure 13:
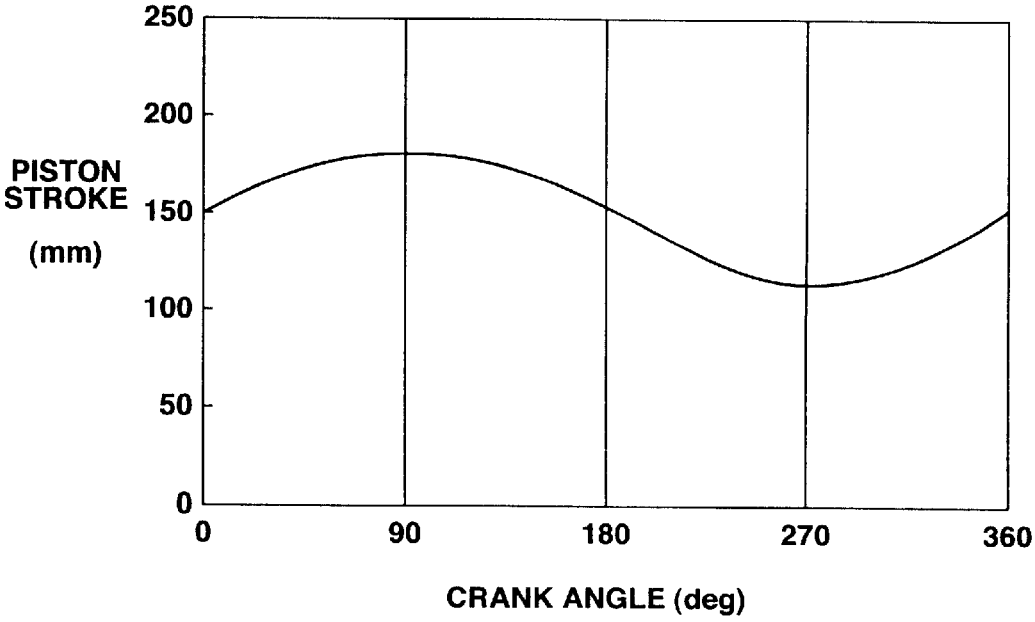
FIG. 13 is a crank angle versus piston stroke characteristic curve obtained by a modification of the mechanism of the second embodiment of FIG. 3.
Figure 16B:
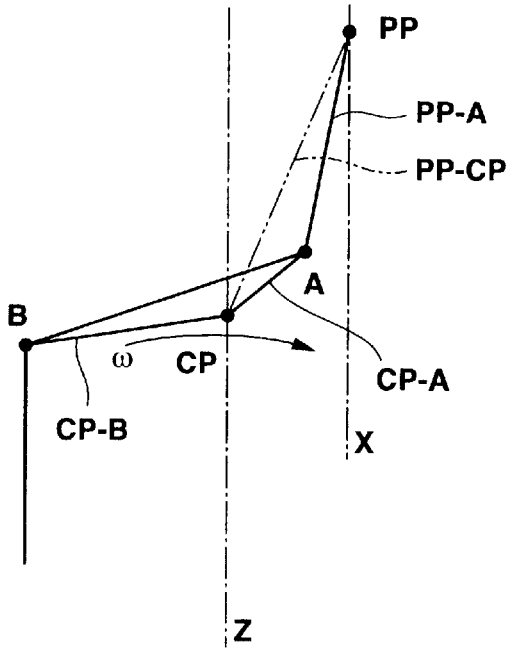
FIG. 16B is a diagrammatic drawing showing the second type (related to FIG. 14B) of the linkage layout (in particular, the relative position relationship among the piston pin center PP, connecting point A, crankpin center CP, and connecting point B) of the embodiment.

Referring now to FIG. 3, there is shown the variable compression ratio mechanism of the second embodiment. As discussed previously by reference to FIGS. 14A and 14B, the linkage layout of the variable compression ratio mechanism of the first embodiment of FIG. 1 corresponds to the first type shown in FIG. 14A, and thus the left-hand side connecting point A as indicated by the solid line of FIG. 14A is selected as the actual connecting point A. On the contrary, the linkage layout of the variable compression ratio mechanism of the second embodiment of FIG. 3 corresponds to the second type shown in FIG. 14B, and thus the right-hand side connecting point A as indicated by the solid line of FIG. 14B and closer to axial line X is selected as the actual connecting point A. As can be seen from the characteristic curves shown in FIGS. 6A–6D, in particular FIGS. 6B and 6D, in the mechanism of the second embodiment of FIG. 3, at the TDC position, upper link 3 is slightly inclined with respect to axial line X. At the timing point T after TDC, the axial line PP–A of upper link 3 approaches closer to its upright state and thus inclination angle $\phi$ is reduced to substantially 0°. Thus, it is possible to effectively reduce instantaneous energy loss W occurring owing to piston side thrust during reciprocating motion of the piston. FIG. 16B is the diagrammatic drawing of the multiple linkage layout of the mechanism of the second embodiment, and closely related to FIG. 14B. According to the concept of the linkage layout of the invention, as viewed from the diagrammatic drawing of FIG. 16B, at the TDC position, connecting point B is located on a first side of vertical line Z whose first side corresponds to the opposite side of a direction oriented toward connecting point A from line segment PP–CP (exactly, from a plane including both the piston pin axis PP and the crankpin axis CP). Actually, in FIG. 16B, connecting point A between upper and lower links 3 and 4 is laid out on the right-hand side of line segment PP–CP, and therefore control link 7 and connecting point B are both laid out on the left-hand side (the opposite side) of vertical line Z. As can be seen from comparison between the diagrammatic drawings of FIGS. 16A (first embodiment) and 16B (second embodiment), control link 7 incorporated in the variable compression ratio mechanism of the second embodiment is arranged or laid out on the opposite side (see FIG. 16B) of control link 7 of the first embodiment. As can be appreciated from the linkage layout of FIGS. 3 and 16B, in the second embodiment, the center of oscillating motion of control link 7 (that is, the center of eccentric cam 8) is located on the ascending side of crankpin 5 (on the left-hand side of vertical line Z (see FIG. 16B) passing through crank pin center CP and arranged parallel to axial line X), away from axial line X between crankpin 5 and eccentric cam 8. In addition to the above, connecting point B between control link 7 and lower link 4 is located on the same side as eccentric cam 8 (that is, on the left-hand side of vertical line Z). As a result of this, in the same manner as the first embodiment of FIG. 1, the linkage layout of the second embodiment enables the angle $\alpha$ (i.e., $\angle$ACPB) between line segments CP–A and CP–B of the triangle $\Delta$ CPAB to be set at a greater angle. Therefore, it is possible to effectively increase the vertical displacement multiplication effect of lower link 4 serving as the swing arm. FIG. 12 shows the crank angle versus piston stroke characteristic with the linkage layout in which both ends of control link 7 are positioned on the left-hand side of axial line X as shown in FIGS. 3 and 16B. On the contrary, FIG. 13 shows the crank angle versus piston stroke characteristic with the hypothetical control link layout in which both ends of control link 7 are positioned on the right-hand side of axial line X and the hypothetical control link layout and the control link layout shown in FIG. 16B are symmetrical to each other with respect to axial line X. As can be appreciated from comparison between the characteristics of FIGS. 12 and 13, there results in a remarkable difference between piston stroke characteristics by changing the control-link layout with respect to axial line X. Actually, the amplitude (piston stroke) of the characteristic curve of FIG. 12 is longer than that of FIG. 13.

The entire contents of Japanese Patent Application Nos. P2000-206257 (filed Jul. 7, 2000) and P2000-37380 (filed Feb. 16, 2000) are incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A variable compression ratio mechanism of a reciprocating internal combustion engine, comprising:

a piston moveable through a stroke in the engine and having a piston pin;

a crankshaft changing reciprocating motion of the piston into rotating motion and having a crankpin;

a linkage comprising:

an upper link connected at one end to the piston pin; and a lower link connecting the other end of the upper link to the crankpin;

at the top dead center position of the piston, when connecting points between the upper and lower links are able to be supposed on both sides of a line segment connecting a piston-pin center of the piston pin and a crankpin center of the crankpin, and the first one of the connecting points has a smaller inclination angle measured in the same direction as the direction of rotation of the crankshaft from the axial line of reciprocating motion of the piston-pin center and to the line segment connecting the piston-pin center and the first connecting point; as compared to the second connecting point, the first connecting point is set as the actual connecting point between the upper and lower links, wherein the linkage is dimensioned and laid out so that the line segment connecting the piston-pin center and the first connecting point is brought into alignment with the axial line of reciprocating motion of the piston-pin center only during a downstroke of the piston.

2. The variable compression ratio mechanism as claimed in claim 1, wherein the linkage further comprises a control link connected at one end to the lower link and oscillatingly connected at the other end to a body of the engine, and at the top dead center position a connecting point between the lower link and the control link is located on a first side of a vertical line passing through the crankpin center and arranged parallel to the axial line, while the first connecting point is located on the second side of the vertical line, the first side of vertical line corresponding to the opposite side of a direction oriented toward the first connecting point from the line segment connecting the piston-pin center and the crankpin center.

3. The variable compression ratio mechanism as claimed in claim 2, wherein, in a first triangle formed by the crankpin center, the first connecting point between the upper and lower links, and the connecting point between the lower link and the control link, an angle between a line segment connecting the crankpin center and the first connecting point and a line segment connecting the crankpin center and the connecting point between the lower link and the control link is greater than the angle between the line segments of a second triangle formed when a hypothetical connecting point included in the second triangle is laid out to be symmetrical to the connecting point included in the first triangle between the lower link and the control link with respect to the axial line.

4. The variable compression ratio mechanism as claimed in claim 2, further comprising a first connecting pin via which the upper and lower links are pin-connected to each other to permit relative rotation of the upper link about an axis of the first connecting pin and relative rotation of the lower link about the axis of the first connecting pin at the first connecting point between the upper and lower links, and a second connecting pin via which the lower link and the control link are pin-connected to each other to permit relative rotation of the lower link about an axis of the second connecting pin and relative rotation of the control link about the axis of the second connecting pin at the connecting point between the lower link and the control link.

5. The variable compression ratio mechanism as claimed in claim 4, further comprising an eccentric cam that creates a displacement of a pivot of oscillating motion of the control link with respect to the body of the engine, to vary a compression ratio of the engine.

6. A variable compression ratio mechanism of a reciprocating internal combustion engine, comprising:

a piston moveable through a stroke in the engine and having a piston pin;

a crankshaft changing reciprocating motion of the piston into rotating motion and having a crankpin;

a linkage comprising:

an upper link connected at one end to the piston pin; and a lower link connecting the other end of the upper link to the crankpin;

at the top dead center position of the piston, when connecting points between the upper and lower links are able to be supposed on both sides of a line segment connecting a piston-pin center of the piston pin and a crankpin center of the crankpin, and the first one of the connecting points has a smaller inclination angle measured in the same direction as the direction of rotation of the crankshaft from the axial line of reciprocating motion of the piston-pin center and to the line segment connecting the piston-pin center and the first connecting point; as compared to the second connecting point, the first connecting point is set as the actual connecting point between the upper and lower links, wherein the linkage is dimensioned and laid out so that the line segment connecting the piston-pin center and the first connecting point is brought into alignment with the axial line of reciprocating motion of the piston-pin center only during a time period from the top dead center position to a timing point that a piston velocity reaches a peak value.

7. A variable compression ratio mechanism of a reciprocating internal combustion engine, comprising:

a piston moveable through a stroke in the engine and having a piston pin;

a crankshaft changing reciprocating motion of the piston into rotating motion and having a crankpin;

a linkage comprising:

an upper link connected at one end to the piston pin; and a lower link connecting the other end of the upper link to the crankpin;

at the top dead center position of the piston, when connecting points between the upper and lower links are able to be supposed on both sides of a line segment connecting a piston-pin center of the piston pin and a crankpin center of the crankpin, and the first one of the connecting points has a smaller inclination angle measured in the same direction as the direction of rotation of the crankshaft from the axial line of reciprocating motion of the piston-pin center and to the line segment connecting the piston-pin center and the first connecting point; as compared to the second connecting point, the first connecting point is set as the actual connecting point between the upper and lower links, wherein an absolute value of the inclination angle given at a timing point that an absolute value of a product of the piston velocity and combustion load reaches a maximum value is set to be smaller than the absolute value of the inclination angle given at the top dead center position.

8. A variable compression ratio mechanism of a reciprocating internal combustion engine, comprising:

a piston moveable through a stroke in the engine and having a piston pin;

a crankshaft changing reciprocating motion of the piston into rotating motion and having a crankpin;

a linkage comprising:

an upper link connected at one end to the piston pin; and a lower link connecting the other end of the upper link to the crankpin;

at the top dead center position of the piston, when connecting points between the upper and lower links are able to be supposed on both sides of a line segment connecting a piston-pin center of the piston pin and a crankpin center of the crankpin, and the first one of the connecting points has a smaller inclination angle measured in the same direction as the direction of rotation of the crankshaft from the axial line of reciprocating motion of the piston-pin center and to the line segment connecting the piston-pin center and the first connecting point; as compared to the second connecting point, the first connecting point is set as the actual connecting point between the upper and lower links, wherein a state that the line segment connecting the piston-pin center and the first connecting point is brought into alignment with the axial line of reciprocating motion of the piston-pin center, exists at a timing point that an absolute value of a product of the piston velocity and combustion load reaches a maximum value, within a whole operating range of the engine.

9. A variable compression ratio mechanism of a reciprocating internal combustion engine, comprising:

a piston moveable through a stroke in the engine and having a piston pin;

a crankshaft changing reciprocating motion of the piston into rotating motion and having a crankpin;

a linkage comprising:

an upper link connected at one end to the piston pin; and a lower link connecting the other end of the upper link to the crankpin;

at the top dead center position of the piston, when connecting points between the upper and lower links are able to be supposed on both sides of a line segment connecting a piston-pin center of the piston pin and a crankpin center of the crankpin, and the first one of the connecting points has a smaller inclination angle measured in the same direction as the direction of rotation of the crankshaft from the axial line of reciprocating motion of the piston-pin center and to the line segment connecting the piston-pin center and the first connecting point; as compared to the second connecting point, the first connecting point is set as the actual connecting point between the upper and lower links, wherein an absolute value of the inclination angle obtained during a high compression ratio operating mode at a timing point that an absolute value of a product of a piston velocity and combustion load reaches a maximum value is relatively smaller than the absolute value of the inclination angle obtained during a low compression ratio operating mode at the timing point.

* * * * *